US006027226A

United States Patent [19]

Shiau

[11] Patent Number: 6,027,226

[45] Date of Patent: Feb. 22, 2000

[54] VARIABLE-FOCUSING HEAD CAP ASSEMBLY FOR A FLASHLIGHT

[76] Inventor: Shoei-Shuh Shiau, No. 10, Alley 1, Lane 551, Sec. 1, Wan-Shou Rd., Guei-Shan Hsiang, Tao-Yuan Hsien, Taiwan

[21] Appl. No.: 09/190,137

[22] Filed: Nov. 12, 1998

[51] Int. Cl.[7] ..... F21L 7/00

[52] U.S. Cl. ..... 362/186; 362/187; 362/293

[58] Field of Search ..... 362/186, 187, 362/202, 208, 293, 277, 319

[56] References Cited

U.S. PATENT DOCUMENTS

| | | | |
|---|---|---|---|
| 4,821,156 | 4/1989 | Siefert et al. | 362/187 |
| 5,014,171 | 5/1991 | Price, III | 362/293 X |
| 5,816,688 | 10/1998 | Shui-Shang | 362/187 X |

*Primary Examiner*—Stephen Husar
*Attorney, Agent, or Firm*—Foley & Lardner

[57] ABSTRACT

A variable-focusing head cap assembly is used in a flashlight having a barrel and a lamp mounted on one end of the barrel. The variable-focusing head cap assembly includes a tubular coupling sleeve, a parabolic reflector, a cap member, and a generally C-shaped resilient friction ring. The C-shaped resilient friction ring is received in an annular receiving groove that is formed in one of the inner peripheral surface of a cap body of the cap member and the outer peripheral surface of the coupling sleeve, and is in friction contact with the other one of the inner peripheral surface of a cap body of the cap member and the outer peripheral surface of the coupling sleeve so as to retain the cap body at a desired axial position along the coupling sleeve and obtain a desired focusing effect.

8 Claims, 5 Drawing Sheets

VARIABLE-FOCUSING HEAD CAP ASSEMBLY FOR A FLASHLIGHT

BACKGROUND OF THE INVENTION

1. Field of the Invention

The invention relates to a variable-focusing head cap assembly for a flashlight, more particularly to a variable-focusing head cap assembly that can be switched stably to provide a colored or normal light output.

2. Description of the Related Art

Referring FIGS. 1 to 3, a conventional head cap assembly for a flashlight is shown to comprise a tubular coupling sleeve 11, a parabolic reflector 111, and a cap member 10. The coupling sleeve 11 has a rear section 113 that is adapted to be mounted securely on the one end of a barrel 12 of the flashlight, and a front section 114 that extends forwardly from the rear section 113 and that is adapted to surround a lamp 121 that is mounted on one end of the barrel 12. The coupling sleeve 11 has an outer peripheral surface 115 and an annular stub 112 formed on the outer peripheral surface 115. The parabolic reflector 111 is disposed in the front section 114 of the coupling sleeve 11 and is provided with an open tail end 116 that is adapted to permit extension of the lamp 121 therein. The cap member 10 includes a tubular cap body 104, a planar lens 105, and a tubular colored light shield 101. The cap body 104 has a rear portion 107 sleeved slidably over the front section 114 of the coupling sleeve 11, a front portion 106, and an inner peripheral surface 108. The cap body 104 further has two annular stubs 102, 102' formed inwardly at the rear portion 107 to define an annular engaging groove 103 in the inner peripheral surface 108. The planar lens 105 is mounted in the front portion 106 of the cap body 104. The light shield 101 is made of a light transmissible material, and has a front end 1011 mounted on the planar lens 105 and an opposite open rear end 1012. The light shield 101 extends rearwardly from the planar lens 105 inside the cap body 104, and is adapted to permit extension of the lamp 121 therein via the open rear end 1012.

The cap body 104 is slidable relative to the coupling sleeve 11 between a fully retracted position, where the lamp 121 extends into the light shield 101 to permit generation of a colored light output, and the annular stub 112 is removed from the annular engaging groove 103, as best shown in FIG. 3, and a fully extended position, where the lamp 121 ceases to extend into the light shield 101 to permit generation of a normal light output, and the annular stub 112 engages the annular engaging groove 103, as best shown in FIG. 2.

The following are some of the drawbacks of the conventional head cap assembly:

1. The coupling arrangement between of the cap body 104 and the coupling sleeve 11 results in instability when the cap body 104 is slid along the coupling sleeve 11.

2. Friction between the annular stub 112 and the inner peripheral surface 108 of the cap body 104 can result in wearing that can lead to untimely removal of the cap body 104 from the coupling sleeve 11.

3. The annular engaging groove 103, the annular stubs 102 (102'), and the annular stub 112 only serve to mount the cap body 104 on the coupling sleeve 11 and are not capable of retaining the cap body 104 at a desired axial position along the coupling sleeve 11 to obtain a desired focusing effect.

SUMMARY OF THE INVENTION

Therefore, the main object of the present invention is to provide a variable-focusing head cap assembly for a flashlight which can overcome the drawbacks associated with the aforesaid prior art.

According to this invention, a variable-focusing head cap assembly is adapted for use with a flashlight having a barrel and a lamp mounted on the one end of the barrel. The variable-focusing head cap assembly comprises a tubular coupling sleeve, a parabolic reflector, a cap member, and a generally C-shaped resilient friction ring. The coupling sleeve has a rear section that is adapted to be mounted securely on the barrel, and a front section that extends forwardly from the rear section and that is adapted to surround the lamp The coupling sleeve has an outer peripheral surface. The parabolic reflector is disposed in the front section of the coupling sleeve, and is provided with an open tail end that is adapted to permit extension of the lamp therein. The cap member includes a tubular cap body, a planar lens, and a tubular colored light shield. The cap body has a rear portion sleeved slidably over the front section of the coupling sleeve, and a front portion. The cap body further has an inner peripheral surface. The planar lens is mounted in the front portion of the cap body. The light shield is made of a light transmissible material, and has a front end mounted on the planar lens and an opposite open rear end. The light shield extends rearwardly from the planar lens inside the cap body, and is adapted to permit extension of the lamp therein via the open rear end. The cap body is slidable relative to the coupling sleeve between a fully retracted position, where the lamp extends into the light shield to permit generation of a colored light output, and a fully extended position, where the lamp ceases to extend into the light shield to permit generation of a normal light output. An annular receiving groove is formed in one of the inner peripheral surface of the cap body and the outer peripheral surface of the coupling sleeve. The friction ring is received in the annular receiving groove, and is in friction contact with the other one of the inner peripheral surface of the cap body and the outer peripheral surface of the coupling sleeve so as to retain the cap body at a desired axial position along the coupling sleeve and obtain a desired focusing effect.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
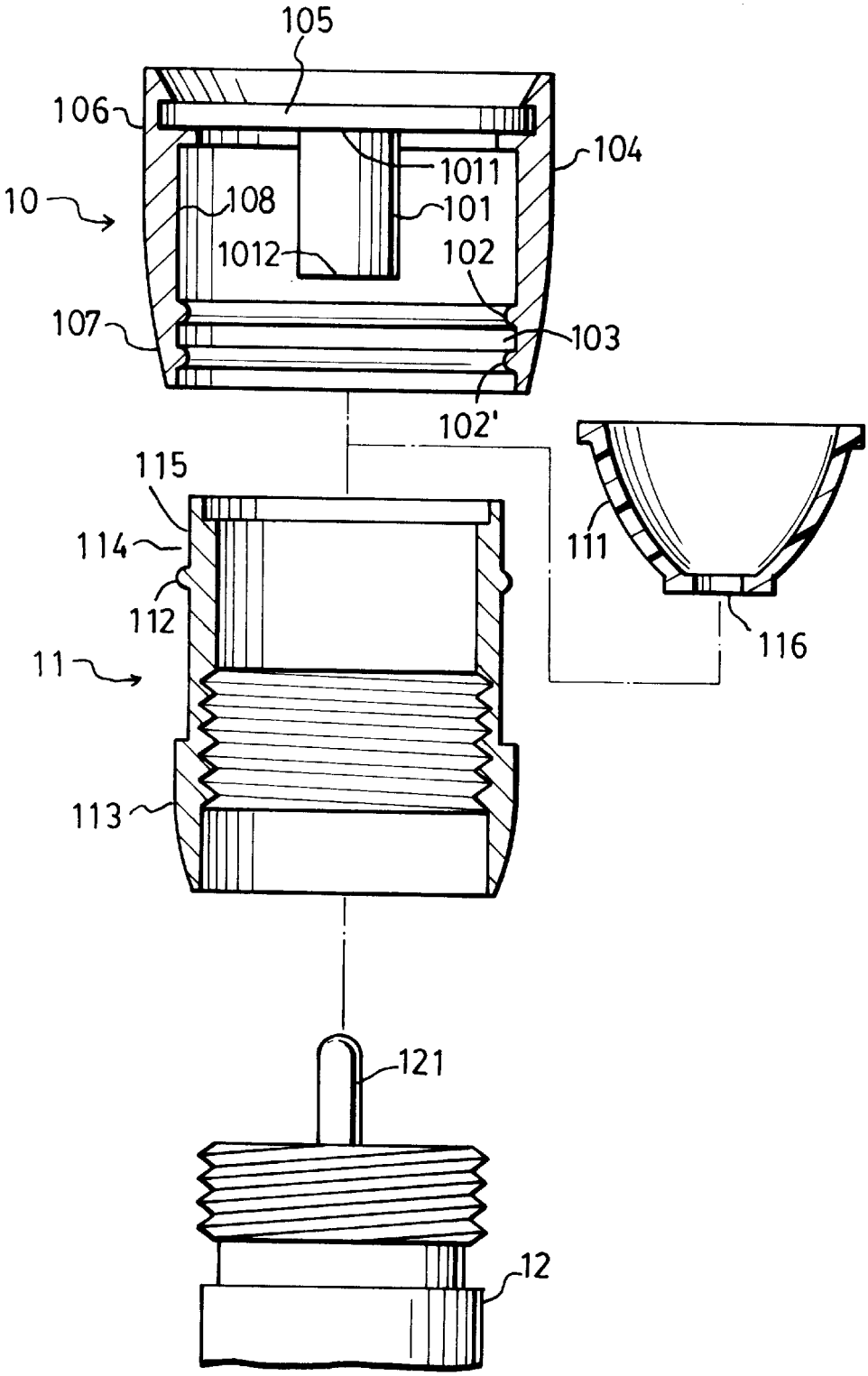
FIG. 1 PRIOR ART
FIG. 1 is a sectional exploded view showing a conventional head cap assembly for a flashlight.
Figure 2:
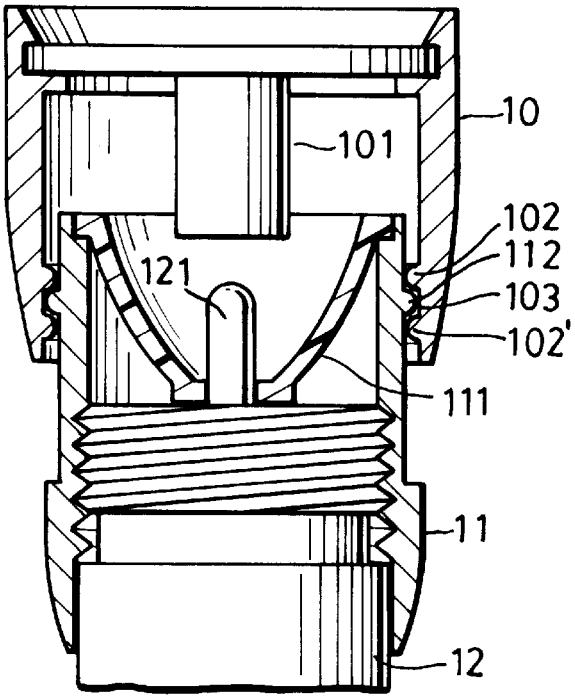
FIG.2 PRIOR ART
FIG. 2 is a sectional schematic view showing the conventional head cap assembly in a fully extended state.
Figure 3:
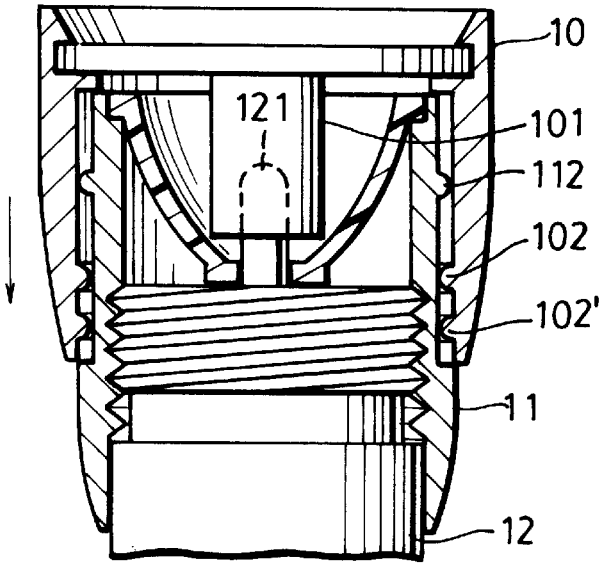
FIG.3 PRIOR ART
FIG. 3 is a sectional schematic view showing the conventional head cap assembly in a fully retracted state.
Figure 4:
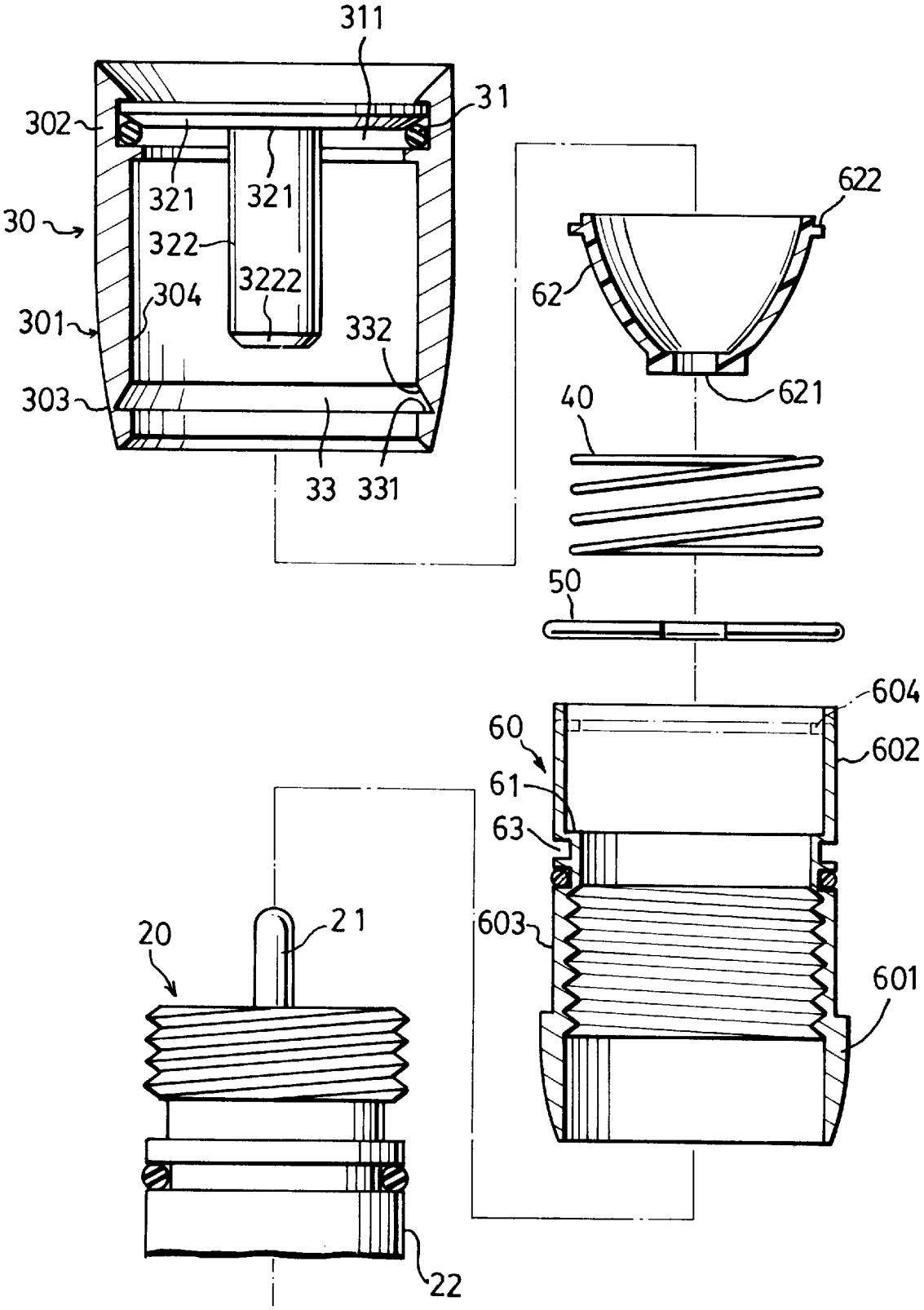
FIG. 4 is a sectional exploded view showing the preferred embodiment of a variable-focusing head cap assembly of this invention.
Figure 5:
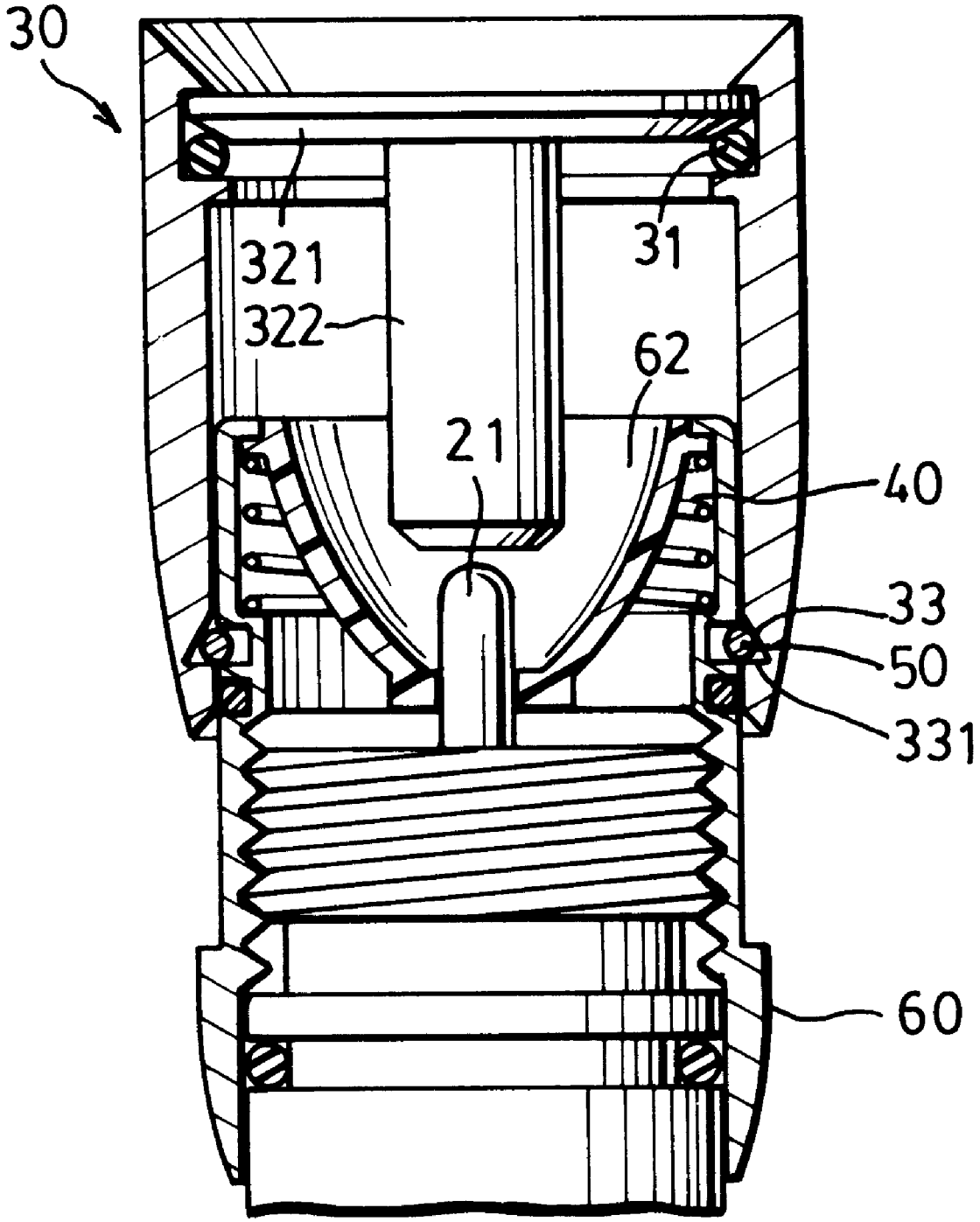
FIG. 5 is a sectional schematic view showing the preferred embodiment in a fully extended state.

Referring to FIGS. 4 and 5, according to the preferred embodiment of this invention, a variable-focusing head cap assembly for a flashlight 20 is shown to comprise a tubular coupling sleeve 60, a spring 40, a parabolic reflector 62, a cap member 30, and a generally C-shaped resilient friction ring 50.

The coupling sleeve 60 has a rear section 601 that is adapted to be mounted securely on one end of a barrel 22 of the flashlight 20, and a front section 602 that extends forwardly from the rear section 601 and that is adapted to surround a lamp 21 that is mounted on one end of the barrel 22. The coupling sleeve 60 has an outer peripheral surface 603. An annular receiving groove 63 is formed in the outer peripheral surface 603 of the coupling sleeve 60. The front section 602 of the coupling sleeve 60 has a distal front end formed with a radial inward limiting flange 604, and a radial inward spring seat flange 61 axially spaced apart from the limiting flange 604.

The parabolic reflector 62 is disposed in the front section 602 of the coupling sleeve 60, and is provided with an open tail end 621 that is adapted to permit extension of the lamp 21 therein. The parabolic reflector 62, which is slidably retained in the front section 602 of the coupling sleeve 60, has an open front end formed with a radial outward abutment flange 622.

The spring 40 is disposed in the coupling sleeve 60 to bias the parabolic reflector 62 forwardly in the coupling sleeve 60. The spring 40 has a front end abutting against the abutment flange 622, and a rear end seated on the spring seat flange 61. Thus, the spring 40 biases the parabolic reflector 62 away from the spring seat flange 61 such that the abutment flange 622 abuts normally against the limiting flange 604.

The cap member 30 includes a tubular cap body 301, a planar lens 321, a tubular colored light shield 322, and a seal ring 31.

The cap body 301 has a rear portion 303 sleeved slidably over the front section 602 of the coupling sleeve 60, and a front portion 302. The cap body 301 further has an inner peripheral surface 304. A beveled control groove 33 is formed in the inner peripheral surface 304 of the cap body 301.

The planar lens 321 is mounted in the front portion 302 of the cap body 301. Preferably, the inner peripheral surface 304 of the cap body 301 is formed with an annular lens mounting groove 311 in the front portion 302 of the cap body 301. The planar lens 321 has a peripheral portion that engages the lens mounting groove 311 to mount the planar lens 321 on the cap body 301.

The seal ring 31 is received in the lens mounting groove 311 to prevent leakage of water into the cap body 301 via the lens mounting groove 311.

The light shield 322 is made of a light transmissible material, and has a front end 3221 mounted on the planar lens 321 and an opposite open rear end 3222. The light shield 322 extends rearwardly from the planar lens 321 inside the cap body 301, and is adapted to permit extension of the lamp 21 therein via the open rear end 3222.

Figure 6:
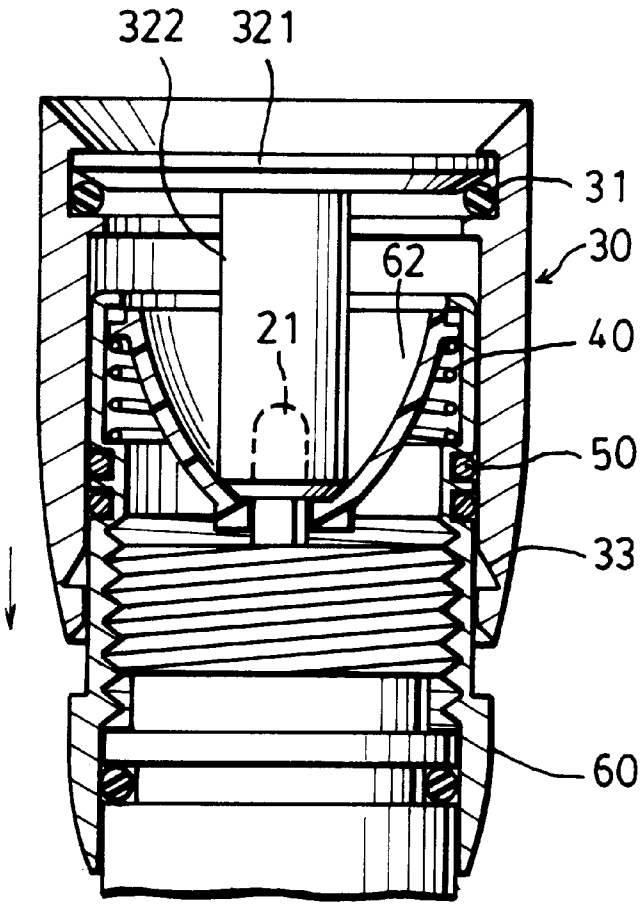
FIG. 6 is a sectional schematic view showing the preferred embodiment when moved from the fully extended state to a fully retracted state.

The cap body 301 is slidable relative to the coupling sleeve 60 between a fully retracted position, where the lamp 21 extends into the light shield 322 to permit generation of a colored light output, as best shown in FIG. 6, and a fully extended position, where the lamp 21 ceases to extend into the light shield 322 to permit generation of a normal light output, as best shown in FIG. 5.

The friction ring 50 is received in the annular receiving groove 63, and is in friction contact with the inner peripheral surface 304 of the cap body 301. The friction ring 50 is capable of retaining the cap body 301 at a desired axial position along the coupling sleeve 60 in order to obtain a desired focusing effect.

The annular beveled control groove 33 is defined by an inclined guiding face 332 and a planar limiting face 331. As shown in FIGS. 5 and 6, the friction ring 50 is of a dimension sufficient to be guided by the beveled control groove 33 into the annular receiving groove 63 when the cap body 301 is slid from the fully extended position to the fully retracted position, and to be restricted between the beveled control groove 33 and annular receiving groove 63 when the cap body 301 is slid from the fully retracted position to the fully extended position to prevent removal of the cap body 301 from the coupling sleeve 60.

Figure 7:
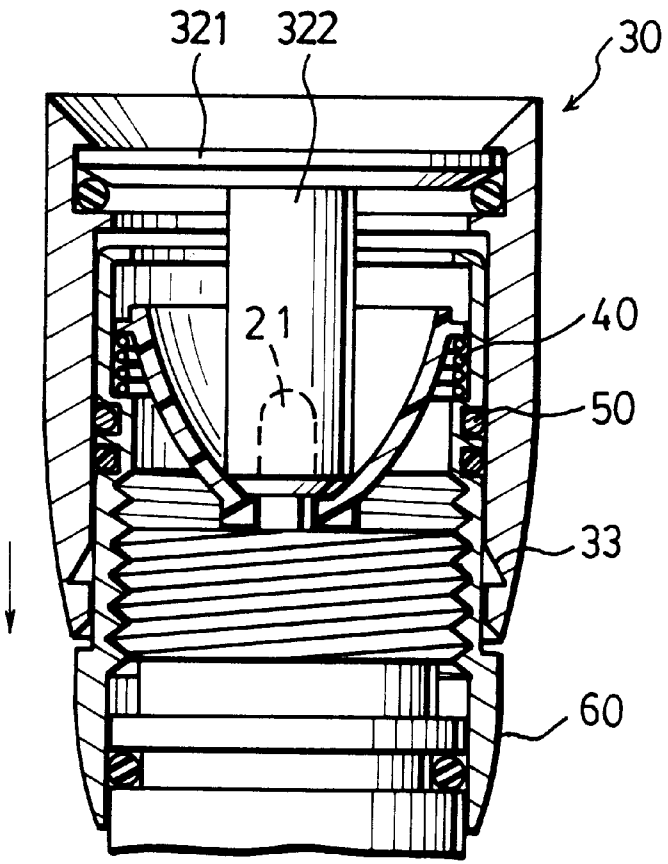
FIG. 7 is a sectional schematic view showing the preferred embodiment in a fully retracted state.

Referring to FIG. 7, when the cap body 301 moves to the fully retracted position, the open rear end 3222 of the light shield 322 abuts against the parabolic reflector 62 and moves the latter in the coupling sleeve 60 against the action of the spring 40 to permit further adjustment of the focusing effect. Preferably, as shown in FIG. 4, the rear section 601 of the coupling sleeve 60 is adapted to be mounted threadedly on the barrel 22, thereby permitting further adjustment of the focusing effect.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A variable-focusing head cap assembly for a flashlight having a barrel and a lamp mounted on one end of the barrel, said head cap assembly comprising:

a tubular coupling sleeve having a rear section that is adapted to be mounted securely on said one end of the barrel, and a front section that extends forwardly from said rear section and that is adapted to surround the lamp, said coupling sleeve having an outer peripheral surface;

a parabolic reflector disposed in said front section of said coupling sleeve and provided with an open tail end that is adapted to permit extension of the lamp therein;

a cap member including a tubular cap body having a rear portion sleeved slidably over said front section of said coupling sleeve, and a front portion, said cap body further having an inner peripheral surface, a planar lens mounted in said front portion of said cap body, and a tubular colored light shield made of a light transmissible material, said light shield having a front end mounted on said planar lens and an opposite open rear end, said light shield extending rearwardly from said planar lens inside said cap body and being adapted to permit extension of the lamp therein via said open rear end, said cap body being slidable relative to said coupling sleeve between a fully retracted position, where the lamp extends into said light shield to permit generation of a colored light output, and a fully extended position, where the lamp ceases to extend into said light shield to permit generation of a normal light output;

one of said inner peripheral surface of said cap body and said outer peripheral surface of said coupling sleeve being formed with an annular receiving groove; and a generally C-shaped resilient friction ring received in said annular receiving groove and in friction contact with the other one of said inner peripheral surface of said cap body and said outer peripheral surface of said coupling sleeve so as to retain said cap body at a desired axial position along said coupling sleeve and obtain a desired focusing effect.

2. The variable-focusing head cap assembly as claimed in claim 1, wherein the other one of said inner peripheral surface of said cap body and said outer peripheral surface of said coupling sleeve is formed with an annular beveled control groove that is defined by an inclined guiding face and a planar limiting face, said friction ring being of a dimension sufficient to be guided by said beveled control groove into said annular receiving groove when said cap body is slid from the fully extended position to the fully retracted position, and to be restricted between said beveled control groove and said annular receiving groove when said cap body is slid from the fully retracted position to the fully extended position to prevent removal of said cap body from said coupling sleeve.

3. The variable-focusing head cap assembly as claimed in claim 2, wherein said annular receiving groove is formed in said outer peripheral surface of said coupling sleeve, and said beveled control groove is formed in said inner peripheral surface of said cap body.

4. The variable-focusing head cap assembly as claimed in claim 3, wherein said annular receiving groove is registered with said beveled control groove when said cap body is in the fully extended position.

5. The variable-focusing head cap assembly as claimed in claim 1, wherein said parabolic reflector is slidably retained in said front section of said coupling sleeve, said head cap assembly further comprising a spring disposed in said coupling sleeve to bias said parabolic reflector forwardly in said coupling sleeve, movement of said cap body to the fully retracted position enabling said open rear end of said light shield to abut against said parabolic reflector and move said parabolic reflector in said coupling sleeve against action of said spring to permit further adjustment of the focusing effect.

6. The variable-focusing head cap assembly as claimed in claim 5, wherein said front section of said coupling sleeve has a distal front end formed with a radial inward limiting flange, said parabolic reflector having an open front end formed with a radial outward abutment flange, said front section of said coupling sleeve further having a radial inward spring seat flange axially spaced apart from said limiting flange, said spring having a front end abutting against said abutment flange and a rear end seated on said spring seat flange, said spring biasing said parabolic reflector away from said spring seat flange such that said abutment flange abuts normally against said limiting flange.

7. The variable-focusing head cap assembly as claimed in claim 1, wherein said rear section of said tubular coupling sleeve is adapted to be mounted threadedly on said one end of the barrel to permit further adjustment of the focusing effect.

8. The variable-focusing head cap assembly as claimed in claim 1, wherein said inner peripheral surface of said cap body is formed with an annular lens mounting groove in said front portion of said cap body, said planar lens having a peripheral portion that engages said lens mounting groove to mount said planar lens on said cap body, said cap member further including a seal ring received in said lens mounting groove to prevent leakage of water into said cap body via said lens mounting groove.

* * * * *